US005395272A

United States Patent [19]

Smith

[11] Patent Number: 5,395,272

[45] Date of Patent: Mar. 7, 1995

[54] STEERING DEVICE FOR JET BOAT

[76] Inventor: Kenneth R. Smith, 102 Mooray Ave., Christchurch, New Zealand

[21] Appl. No.: 169,348

[22] Filed: Dec. 17, 1993

[30] Foreign Application Priority Data

Dec. 22, 1992 [NZ] New Zealand ..... 245557

[51] Int. Cl.[6] ..... B63H 11/113

[52] U.S. Cl. ..... 440/42

[58] Field of Search ..... 440/38, 39, 40, 41, 440/42, 43; 239/265.11, 265.35, 127.1; 60/221, 232; 114/151

[56] References Cited

U.S. PATENT DOCUMENTS 3,090,346 5/1963 Burgin ..... 440/42
3,302,605 2/1967 Kuether ..... 440/42
3,776,173 12/1973 Horwitz ..... 440/42
5,094,182 3/1992 Simner ..... 440/42

*Primary Examiner*—Stephen P. Avila
*Attorney, Agent, or Firm*—Ross, Ross & Flavin

[57] ABSTRACT

A steering device for a jet boat including a housing securable over the water exit at the rear of the jet boat, a steering nozzle movably secured to the housing so that water leaving the housing passes through the nozzle to leave the boat through the nozzle outlet, and means for moving the steering nozzle relative to the housing so as to direct the water leaving the nozzle outlet in a predetermined direction, the steering nozzle being movably secured to the housing by a pivotal connection which permits pivotal movement of the nozzle relative to the housing about a plane which lies at an acute angle to a longitudinal line through the center of the housing.

17 Claims, 5 Drawing Sheets

STEERING DEVICE FOR JET BOAT

The present invention relates to an improved steering device for a jet boat.

Jet boats are propelled by the thrust of the jet of water emitted from the rear of the boat, and the boat is steered by directing that jet.

In one commonly-used steering device, pivoted flaps are mounted in the exhaust nozzle, and the angle of the flaps controls the direction of the exhaust jet. However, the flaps break up the smooth flow of water through the exhaust nozzle and thus reduce the efficiency of the steering effect.

More efficient steering is achieved by an exhaust nozzle mounted in an outer housing so as to be capable of pivoting from side to side about a vertical axis, directing the whole exhaust jet in the desired direction for steering. This design is more effective than the steering flaps, but has one major drawback: the inner joint between the nozzle and the housing cannot be made completely smooth for all orientations of the nozzle. Thus, in some positions of the nozzle, the rear surface of the nozzle forms a ledge inside the housing, and small stones which have passed through the stone screen frequently lodge against this ledge, and can jam the steering nozzle in that position. If this happens when the boat is travelling fast and turning sharply, the results can be dramatic, since the boat's course cannot be corrected. It is not feasible to use a very fine screen, since this unduly slows and restricts the water flow.

It is therefore an object of the present invention to provide a steering device which includes a steerable exhaust nozzle and which overcomes the above-described drawback and provides consistently safe and effective steering.

The present invention provides a steering device for a jet boat, said steering device including a tubular housing securable over the water exit at the rear of a jet boat, a steering nozzle movably secured to said housing, so that water leaving the boat passes first through said housing and then through said nozzle to leave the boat through the nozzle outlet, and means for moving the steering nozzle relative to the housing, so as to direct the water leaving the nozzle outlet in a pre-determined direction, characterized in that said steering nozzle is movably secured to the housing by a pivotal connection which permits pivotal movement of the nozzle relative to the housing about a plane which lies at an acute angle to a longitudinal line through the centre of the housing; said pivotal connection being such that no part of the nozzle projects inwards into the bore of the housing at any position of the nozzle relative to the housing; and the housing and the nozzle are aligned such that when the nozzle is in the "straight ahead" steering position, the longitudinal line through the centre of the housing is aligned with a longitudinal line through the centre of the nozzle, so as to minimize directional change for water passing through the housing and the nozzle.

Said acute angle can be the angle measured between said plane and said longitudinal line through the centre of the housing either with the pivotal connection inclined such that its upper part slopes towards the nozzle outlet, or with the pivotal connection inclined such that its upper part slopes away from the nozzle outlet.

Preferably, said acute angle is in the range 30°–50°.

The pivotal connection may be any suitable type of pivotal joint, and may, but need not, incorporate means for securing the nozzle and housing together.

Preferably, the pivotal connection comprises a bearing, part of which is secured to the housing and the other part of which is secured to the nozzle, so that the bearing also secures the housing and nozzle together. The bearing may be a two-part race with the bearing cavity filled with a suitable low-friction component(s) such as roller bearings, ball bearings or low-friction flexible rod or tube. Alternatively, the bearing may be a plain bearing or other suitable known bearing.

By way of example only, a preferred embodiment of the present invention is described in detail with reference to the accompanying drawings, in which.

Figure 1:
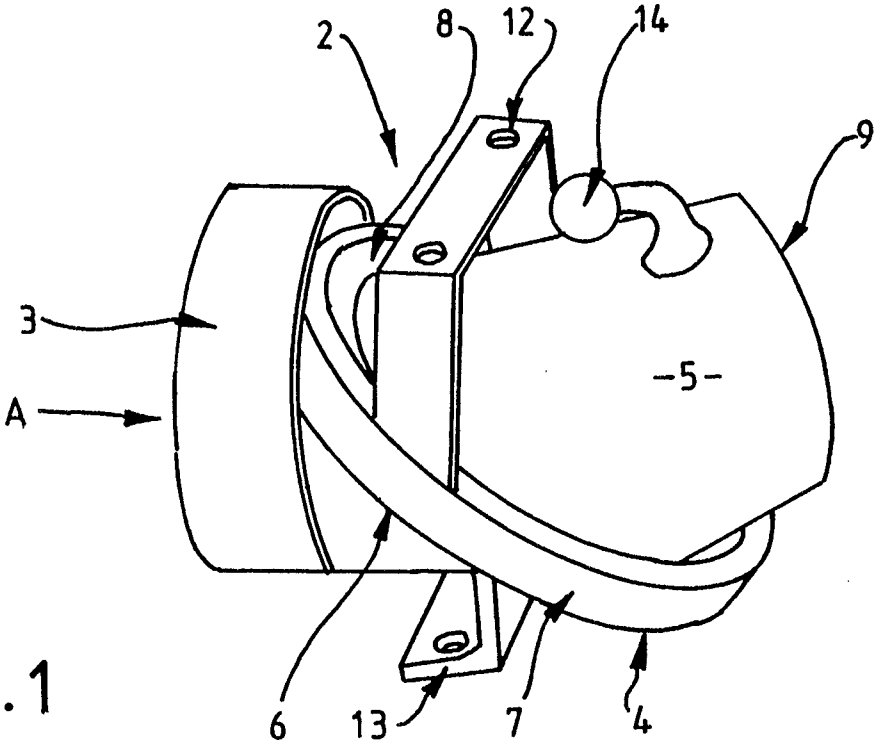
FIG. 1 is an isometric view of a first embodiment of the device of the present invention.
Figure 2:
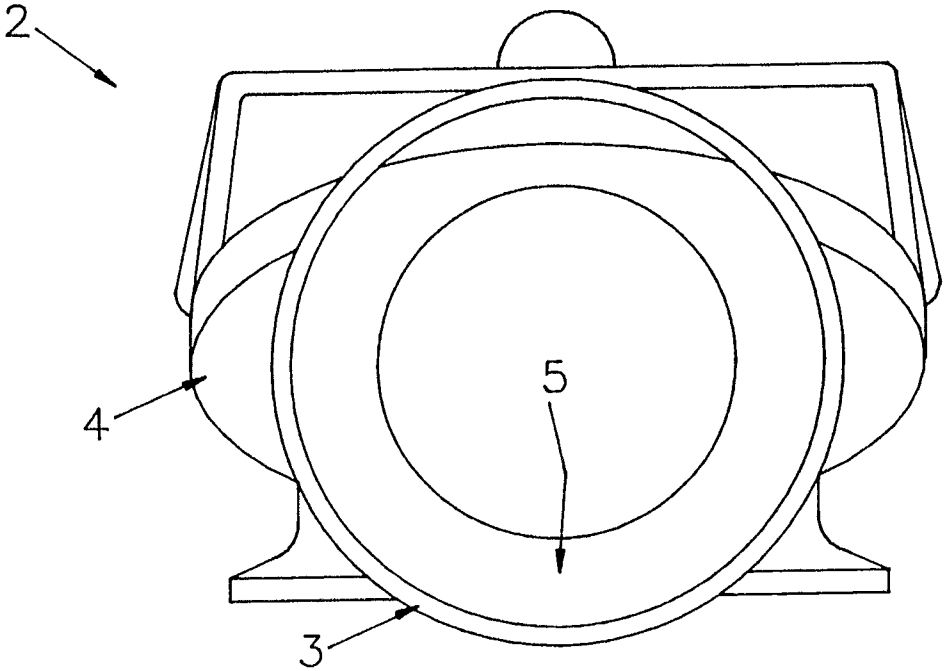
FIG. 2 is a view in the direction of arrow A of FIG. 1 (on an enlarged scale)
Figure 3:
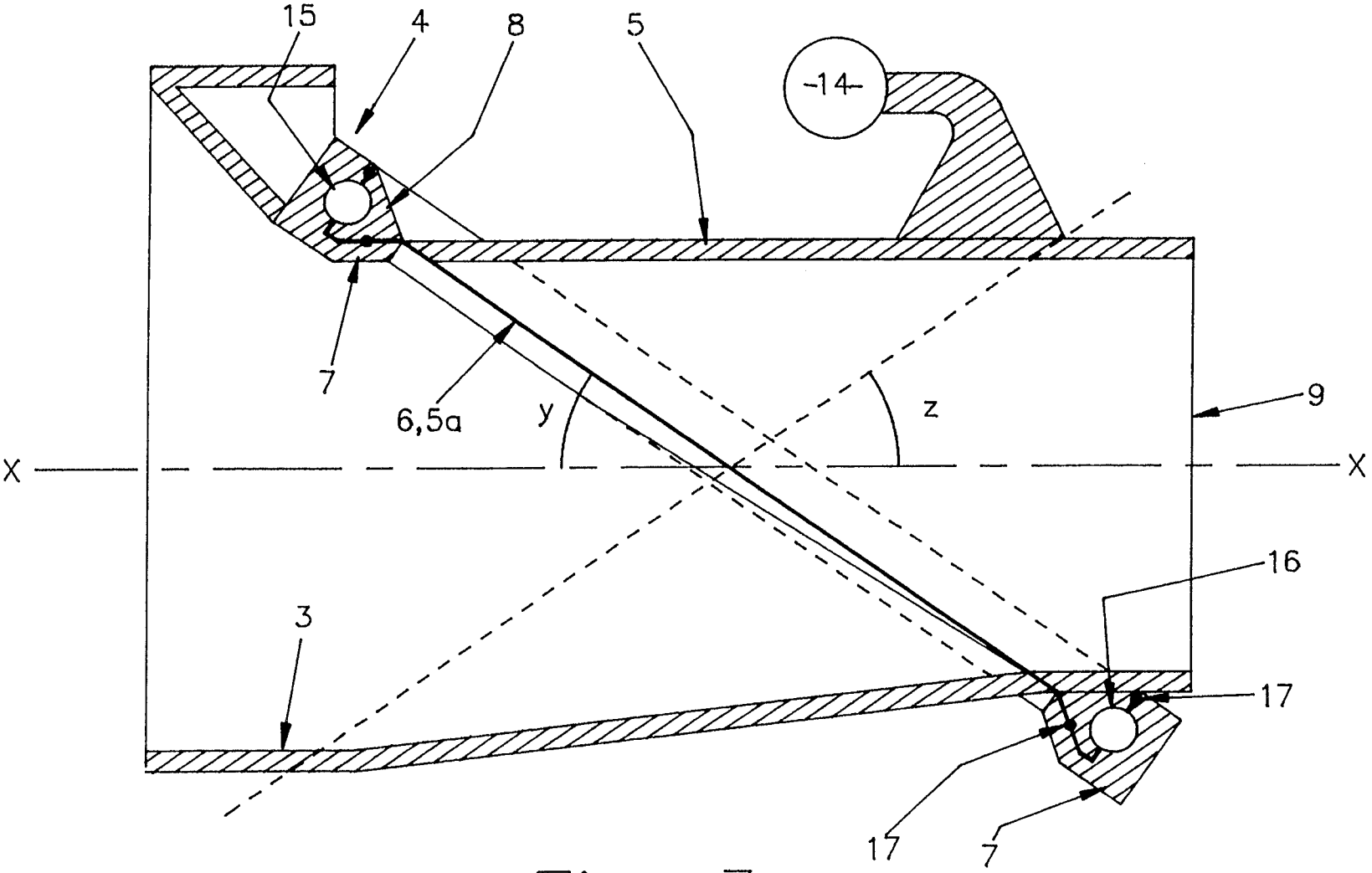
FIG. 3 is a vertical section through the device, on an enlarged scale.

Referring to FIGS. 1–3 of the drawings, a steering device 2 comprises a housing 3 upon which is mounted a ball race 4, which carries a steering nozzle 5.

The housing 3 consists of a tube having an inner diameter equal to the inner diameter of the jet boat outlet. The tube is cut away to provide an inclined surface 6 to which the outer race 7 of the ball race 4 is rigidly secured. The surface 6 (and hence the race 4 also) are inclined at an acute angle y to a longitudinal line X—X through the centre of the housing, for the reasons explained hereinafter.

The inner race 8 of the ball race 4 can rotate freely relative to the outer race. To the inner race 8 is rigidly secured the steering nozzle 5, which consists of an elliptical cross-section tube of tapering internal diameter: the tube's diameter adjacent the ball race is equal to that of the ball race, but tapers to a slightly smaller diameter at the outlet 9 of the nozzle. This tapering diameter increases the exit velocity of water leaving the nozzle, and hence increases the steering thrust of the water jet.

The inner and outer race of the ball race may be secured to the steering nozzle and the housing respectively by being formed as a one-piece casting or being formed as separate components and welded together.

The nozzle 5 is diagonally cut-away to provide an inclined surface 5*a*, the angle of which matches the angle of the surface 6, so that the nozzle 5 fits evenly against the inner race 8, with no sharp edges or protrusions.

In use, the device is secured in position at the end of the jet outlet on a boat by means of brackets 12, 13, (FIG. 1 & 2 only) secured to the outer race 7 and the housing 3. These brackets may be varied in shape and position to suit different boat designs. Thus, all water leaving the jet outlet passes through first the housing 3 and then the nozzle 5.

The device is used to steer the boat by directing the jet outlet water through the steering nozzle 5, and altering the angle of the nozzle 5 as required to direct the thrust in the required direction and hence steer the boat, in known manner.

The position of the nozzle 5 is adjusted by the driver of the boat, using control rods of known type connected to a socket (not shown) which encloses a steering ball 14 rigidly secured to the upper surface of the nozzle 5, adjacent its outer end. Movement of the steering ball 14 rotates the nozzle 5 and the inner race 8 relative to the outer race 7 and the housing 3. The fact that the ball-race 4 and nozzle 5 are at an acute angle y to the longitudinal line X—X through the centre of the housing (i.e. with the ball race 4 inclined with its upper part away from the nozzle outlet 9) means that as the nozzle 5 turns, the outlet 9 of the nozzle, and hence the water jet, not only turn from side to side, but also move up the incline of the ball-race. Thus, the more the nozzle is turned away from the 'straight ahead' position of FIG. 2, the higher the outlet 9 of the nozzle. This gives the boat improved water-holding characteristics, because the angled jet of water leaving through the nozzle steers the boat in the opposite direction and also, because the jet is both angled laterally and inclined upwards, the jet tends to push the tail of the boat downwards as the boat turns.

However, for some boat shapes, this tending to push the tail of the boat downwards is unnecessary or even undesirable, in which case an alternative construction (shown in dotted lines in FIG. 3 only) may be used: in this variant, the ball race 4 is inclined at an acute angle Z to the line i.e., the ball race 4 is inclined with its upper part towards the nozzle outlet. Thus, as the nozzle is turned away from the "straight ahead" position, the lower the outer end of the nozzle, tending to push the tail of the boat upwards as the boat turns.

It will be appreciated that since the nozzle at all times rotates with the inner ball race, there are no gaps between the nozzle and the housing, no matter what position the nozzle takes. Thus, stones travelling through with the water jet cannot jam the nozzle.

The steering device is fitted with reversing buckets (not shown) in known manner.

Referring especially to FIG. 3, the outer race 7 of the ball race is L-shaped in cross-section, with an inner hemispherical cut-out 15 to accommodate the race balls. The inner race 8 is triangular in cross-section, with a corresponding cut-out 16. To assemble the ball race, the inner and outer races are aligned, and the balls fed into the race through two aligned apertures (not shown) formed in the races. When all the balls have been inserted, the inner race is turned so that the insertion holes are no longer aligned. The insertion holes are turned so far out of alignment that they cannot be accidentally re-aligned during use, but can be re-aligned only by dismantling the steering gear completely. In use, the boat will turn lock-to-lock with a steering nozzle rotation of the order of 28° on either side of the centre-line of the boat. The race is sealed by a pair of seals 17.

The angles y and z of the ball-race 4 to the direction of water flow are shown as 35° in the drawings, but may be varied to suit particular applications. The smaller the angle, the more effective the steering nozzle, but the greater the interference of the nozzle with the smooth flow of the water jet. An angle of zero would give very effective steering but would require angled ducting to lead the jet outlet into the nozzle. At the other extreme, the closer the angle approaches 90°, the less the interference with the water flow, but the less effective the steering: at 90°, the steering is ineffective. The preferred range for the angles y and z has been found to be 30°–50°: angles in this range give effective steering with relatively little interference in the smooth flow of the water jet.

The size of the discharge end 9 of the nozzle can be varied, to suit different horsepower-ratings of engine and different impellor configurations: the greater the diameter of the discharge end 9, the lower the back-pressure.

Figure 4:
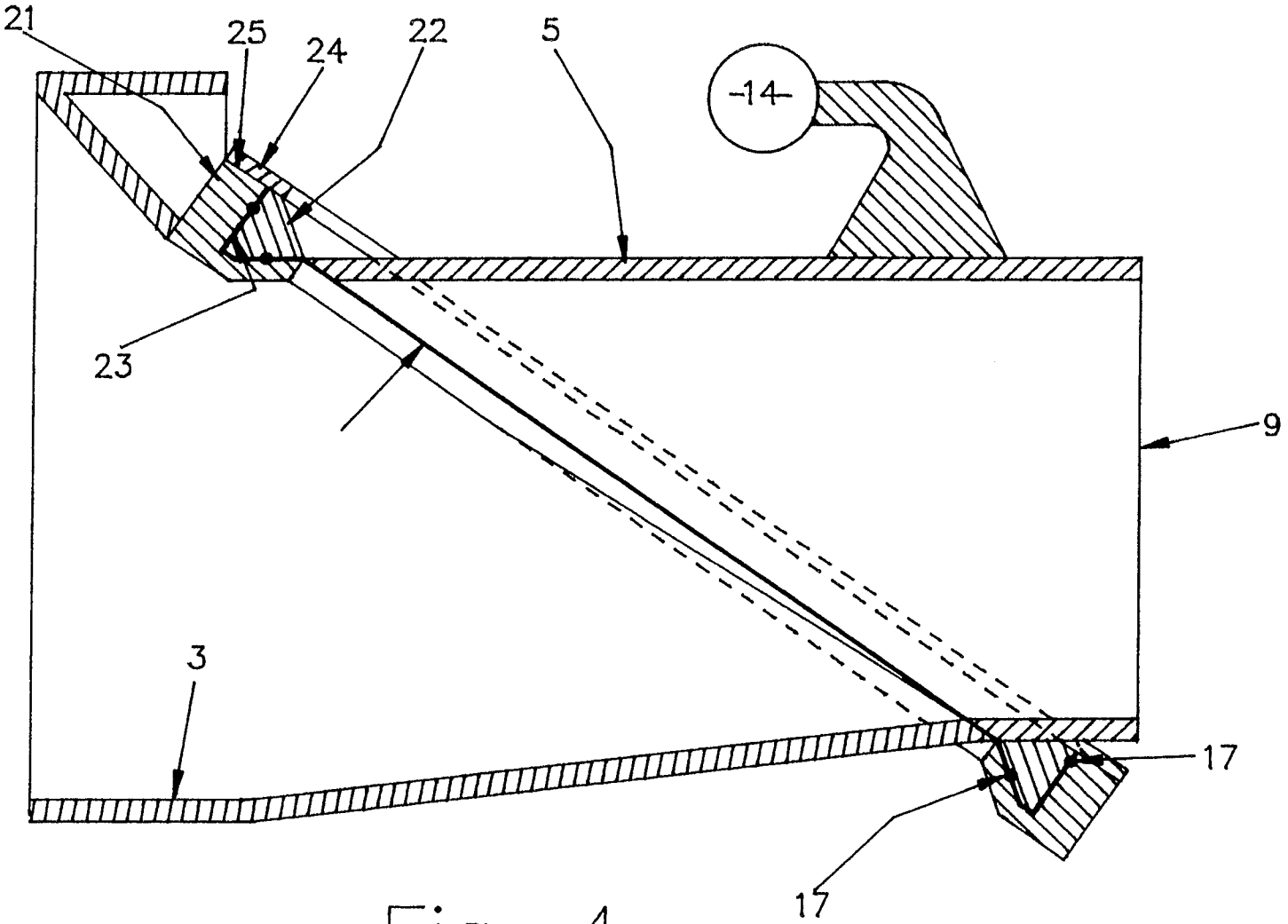
FIGS. 4 & 5 are vertical sections through second and third embodiments of the device, respectively.

FIG. 4 shows a second embodiment of the invention in which a different type of bearing is used.

In this embodiment, the ball race 4 of FIGS. 1–3 is replaced by a two-part plain bearing 20. One part 21 of the bearing 20 is rigidly secured around the end of the housing 3. The part 21 is L-shaped in cross-section and receives a triangular-cross-section part 22 which is rigidly secured to the adjacent end of the nozzle 5. The part 22 can slide around the part 21, and the mating faces of the parts 21, 22 are provided with a layer of wear material 23. As in FIGS. 1–3, the bearing 20 is sealed with two seals 17.

The part 22 is retained in engagement with the part 21 by a keeper plate 24 which is annular and is bolted to the side face 25 of the part 21; the plate 24 overhangs the side of the part 22, preventing the part 22 from sliding out of engagement with the part 21.

Figure 5:
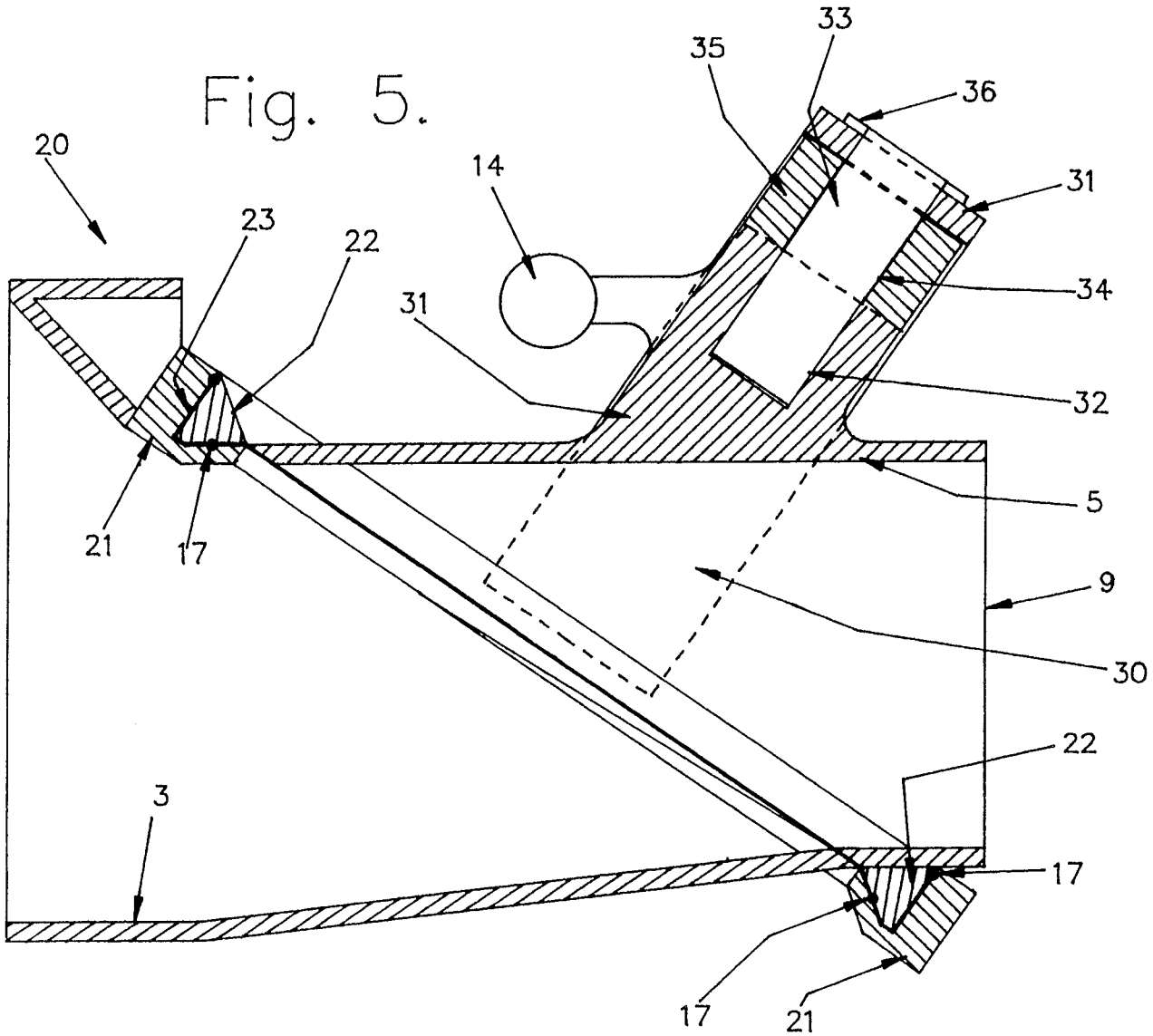

FIG. 5 shows a third embodiment of the invention in which the bearing 20 is the same as in FIG. 4, but the keeper plate 24 is omitted, the housing 3 and the nozzle 5 being held together by a yoke 30.

The yoke 30 is rigidly secured at one end to the part 21 of the bearing, passes around the upper part of the nozzle 5 adjacent the steering ball 14, and is rigidly secured at the other end to the part 21. A projection 31 is formed on the centre of upper external surface of the nozzle 5 adjacent the steering ball 14. The projection 31 is located at the pivot point of the nozzle 5, so that the projection remains constant in position as the nozzle 5 rotates around the bearing 20.

The projection 31 is formed with a central socket 32 which received a T-shaped pivot pin 33. The pivot pin 33 passes through an aperture 34 in the yoke 30, and the end of the pin protrudes into the socket 32. The walls of the aperture 34 are lined with wear material 35. The pin 33 is retained in place by a keeper 36 which is screwed or otherwise secured over the head of the pin.

The nozzle 5 is rotated by means of the steering ball 14, as described with reference to FIGS. 1–3. As the nozzle rotates, the pin 33 rotates in the aperture 34, allowing the nozzle 5 to move freely relative to the bearing. The plane of the yoke 30 is perpendicular to the plane of the bearing 20, so that any tendency for the part 22 to move away from the part 21 to is directly counteracted by the yoke.

Except as described above, the FIG. 4 and FIG. 5 embodiments are the same as the embodiment described with reference to FIGS. 1–3.

It will be appreciated that the method of securing the two parts of the bearing together shown in either of FIG. 4 or FIG. 5 could be used in conjunction with any other suitable type of bearing, e.g. the ball bearing illustrated in FIGS. 1–3.

I claim:

1. A steering device for a jet boat, said steering device including a tubular housing securable over the water exit at the rear of a jet boat, a steering nozzle movably secured to said housing, so that water leaving the boat passes first through said housing and then through said nozzle to leave the boat through the nozzle outlet, and means for moving the steering nozzle relative to the housing, so as to direct the water leaving the nozzle outlet in a pre-determined direction, characterized in that said steering nozzle is movably secured to the housing by a pivotal connection which permits pivotal movement of the nozzle relative to the housing about a plane which lies at an acute angle to a longitudinal line through the centre of the housing; said pivotal connection being such that no part of the nozzle projects inwards into the bore of the housing at any position of the nozzle relative to the housing; and the housing and the nozzle are aligned such that when the nozzle is in the "straight ahead" steering position, the longitudinal line through the centre of the housing is aligned with a longitudinal line through the centre of the nozzle, so as to minimize directional change for water passing through the housing and the nozzle.

2. The steering device as claimed in claim 1 wherein said pivotal connection also secures the steering nozzle to the housing.

3. The steering device as claimed in claim 2, wherein said pivotal connection comprises a bearing, one part of which is secured to the housing and the other part of which is secured to the nozzle, said parts of the bearing being pivotable relative to each other.

4. The steering device as claimed in claim 3 wherein said bearing comprises a two-part race with the bearing cavity filled with a low-friction component selected from the group consisting of: roller bearings, ball bearing, low-friction flexible rod, low-friction flexible tube.

5. The steering device as claimed in claim 1, wherein said pivotal connection comprises a bearing, one part of which is secured to the housing and the other part of which is secured to the nozzle, said parts of the bearing being pivotable relative to each other.

6. The steering device as claimed in claim 5 wherein said one part of the bearing is shaped so as to engage the other part of the bearing, the mating faces of said bearings being formed from, or provided with, a wear material.

7. The steering device as claimed in claim 6 wherein said bearing parts are secured together by an annular plate secured across the ends of said parts.

8. The steering device as claimed in claim 5 wherein said bearing parts are secured together by a yoke secured at each end to the housing and arranged to pass around the nozzle, over the pivot point of the nozzle, said yoke carrying a pivot pin which rotatably engages a socket formed on the exterior of said nozzle, at said pivot point.

9. The steering device as claimed in claim 1 wherein said acute angle is the angle measured between said plane and said longitudinal line through the centre of the housing, with the pivotal connection inclined such that its upper part slopes towards the nozzle outlet.

10. The steering device as claimed in claim 1 wherein said acute angle is the angle measured between said plane and said longitudinal line through the centre of the housing, with the pivotal connection inclined such that its upper part slopes away from the nozzle outlet.

11. The steering device as claimed in claim 4 wherein said acute angle is the angle measured between said plane and said longitudinal line through the centre of the housing, with the pivotal connection inclined such that its upper part slopes towards the nozzle outlet.

12. The steering device as claimed in claim 7 wherein said acute angle is the angle measured between said plane and said longitudinal line through the centre of the housing, with the pivotal connection inclined such that its upper part slopes towards the nozzle outlet.

13. The steering device as claimed in claim 4 wherein said acute angle is the angle measured between said plane and said longitudinal line through the centre of the housing, with the pivotal connection inclined such that its upper part slopes away from the nozzle outlet.

14. The steering device as claimed in claim 7 wherein said acute angle is the angle measured between said plane and said longitudinal line through the centre of the housing, with the pivotal connection inclined such that its upper part slopes away from the nozzle outlet.

15. The steering device as claimed in claim 9 wherein said acute angle lies in the range 30°–50°.

16. The steering device as claimed in claim 10 wherein said acute angle lies in the range 30°–50°.

17. The steering device as claimed in claim 1 wherein the orientation of said steering nozzle relative to said housing is controlled by control rods connected to a steering ball rigidly secured to said nozzle.

* * * * *